US006453785B1

(12) United States Patent
Tokukatsu

(10) Patent No.: US 6,453,785 B1
(45) Date of Patent: Sep. 24, 2002

(54) HOOP MATERIAL CUTTER

(76) Inventor: Seiji Tokukatsu, 25-8, 5-chome, Nisshiarai, Adachi-ku, Tokyo (JP)

( * ) Notice: Subject to any disclaimer, the term of this patent is extended or adjusted under 35 U.S.C. 154(b) by 0 days.

(21) Appl. No.: 09/176,525

(22) Filed: Oct. 21, 1998

(51) Int. Cl.[7] ..... B26D 5/00

(52) U.S. Cl. ..... 83/373; 83/602; 83/628; 83/923

(58) Field of Search ..... 29/898.1; 384/13, 384/50, 56, 44; 83/373, 628, 646, 923, 602

(56) References Cited

U.S. PATENT DOCUMENTS

| | | | | | |
|---|---|---|---|---|---|
| 2,877,063 | A | * | 3/1959 | Janiszewski | 384/13 |
| 3,941,328 | A | * | 3/1976 | Johnson | 242/68.4 |
| 4,664,007 | A | | 5/1987 | Tokukatsu | |
| 5,281,033 | A | * | 1/1994 | Ide | 384/213 |
| 5,694,811 | A | * | 12/1997 | Tsukada | 74/467 |
| 5,711,611 | A | * | 1/1998 | Nagai et al. | 384/50 |
| 6,217,217 | B1 | * | 4/2001 | Teramachi | 384/44 |
| 6,241,170 | B1 | * | 6/2001 | St Clair | 241/167 |

FOREIGN PATENT DOCUMENTS

| | | | | |
|---|---|---|---|---|
| JP | 1-264712 | * | 10/1989 | 83/856 |
| JP | 2-256413 | * | 10/1990 | 83/523 |
| JP | 7-60531 | | 3/1995 | |
| JP | 7-60532 | | 3/1995 | |

* cited by examiner

*Primary Examiner*—Peter Vo
*Assistant Examiner*—Minh Trinh
(74) *Attorney, Agent, or Firm*—Ostrolenk, Faber, Gerb & Soffen, LLP

(57) ABSTRACT

A hoop material cutter, which comprises a movable blade secured to a bottom surface of a ram movable reciprocally while rocking, a fixed blade secured to a top surface of a base plate, and a hopper for guiding a hoop material between the movable blade and the fixed blade, cuts the hoop material while allowing the movable blade to move toward and away from the fixed blade in accordance with an action of the ram. In this hoop material cutter, cylindrical guide pins are rotatably fitted in the base plate via blocks which are detachable in a horizontal direction from the base plate and each having both ends chamfered, and a part of the cylindrical surface of each guide pin protrudes sideways of the associated block so that the end faces of the movable blade are guided by the protruding portions.

5 Claims, 9 Drawing Sheets

HOOP MATERIAL CUTTER

BACKGROUND OF THE INVENTION

1. Field of the Invention

The present invention relates to a hoop material cutter which is installed on an automatic press machine or the like to cut a scrap hoop material, and, more particularly, to a cutting blade guide for guiding the movable blade of a hoop material cutter in a reciprocating motion.

2. Description of the Related Art

This type of hoop material cutter is known and disclosed in, for example, U.S. Pat. No. 4,664,007. In this hoop material cutter, as shown in FIG. 11, as a cam 10 secured via a key 9 to the shaft 8 of a motor 6 rotates, a ram 4 moves reciprocally via a bearing 19, while rocking, so that a hoop material is cut between a movable blade 3 attached to the bottom side of the ram 4 and a fixed blade 2 secured to the base plate.

Some schemes of guiding the end faces of the movable blade in reciprocation in this hoop material cutter are taught in, for example, Japanese Unexamined Patent Publication No. Hei 7-60531 and Japanese Unexamined Patent Publication No. Hei 7-60532.

According to the invention disclosed in Japanese Unexamined Patent Publication No. Hei 7-60531, as apparent from a plan view of the ram 4 in FIG. 12, both end faces of the movable blade 3 secured to the front portion of the bottom side of the ram 4 are guided by a pair of guide pins 54 which are rotatably provided on a base plate 1. In this structure, the width of the ram 4 is designed smaller than the width of an opening 63 of the base plate 1, and an oil can manually be supplied to the guide pins 54 from the outer surface of the base plate 1 via nipples 62 and oil holes 61.

According to the invention disclosed in Japanese Unexamined Patent Publication No. Hei 7-60532, as shown in FIG. 13, the ram 4 in FIG. 11 is designed in such a way that the distance between two parallel sides 4*a* and 4*b* is set greater than the width of an opening portion 1*a*, 1*b* of the base plate 1 and the wide parallel portion is provided on the slide surface of the base plate 1, thereby ensuring more stable reciprocation of the ram 4. Further, cutting blade guides 28*a* and 28*b* are provided between end faces 3*a* and 3*b* of the movable blade 3 secured to the front end portion of the bottom side of the ram 4 and the inner walls of the opening portion 1*a*, 1*b* of the base plate 1. The cutting blade guides 28*a* and 28*b* are so designed as to fit guide pins 11*a* and 11*b* in a rotatable manner in respective prismatic blocks 29*a* and 29*b*, which are fitted detachable in a horizontal direction from the base plate 1, and to cause the cylindrical surfaces of the guide pins 11*a* and 11*b* to protrude sideways from the associated blocks, whereby the end faces 3*a* and 3*b* of the movable blade 3 are guided by the protruding portions.

The aforementioned conventional hoop material cutter is provided with a hopper 30 which guides a hoop material A between the movable blade 3 and the fixed blade 2 at the time of cutting the hoop material A.

As shown in FIG. 11, the hopper 30 comprises a lower guide 31 for guiding the bottom side of a hoop material A1 and a stock guide 32 provided upright for stopping feeding of a hoop material A2.

As mentioned above, the guide pins 54 of the hoop material cutter described in Japanese Unexamined Patent Publication No. Hei 7-60531 are so designed as to permit manual supply of an oil to the guide pins 54 via the nipples 62 from outside the base plate 1. When a user forgets oil supply to the guide pins 54, for example, and the oil runs out, however, the guide pins 54 will not rotate smoothly, accelerating the wear-out of the cylindrical surfaces, which is likely to cause settling of the guide pins 54. In addition, the attachment of the nipples 62 undesirably makes the side surfaces of the base plate 1 weaker.

The hoop material cutter described in Japanese Unexamined Patent Publication No. Hei 7-60532, as shown in FIG. 13, is constructed in such a manner that the lubricating fluid is supplied to the slide surfaces of the wide parallel portion 4*a*, 4*b* of the ram 4 via oil holes 15, a groove 23, a through hole 17 and a groove 24 from nipples 16 in FIG. 11. Although the fluid is further led to the guide pins 11*a* and 11*b* via the slide surfaces, it is difficult to sufficiently supply the fluid there. As a result, the guide pins 11*a* and 11*b* will not rotate smoothly, so that the cylindrical surfaces of the guide pins 11*a* and 11*b* are apt to wear out. As the cylindrical surfaces of the guide pins 11*a* and 11*b* wear out, therefore, settling occurs at the end portions of the guide pins 11*a* and 11*b*. This settling imparts the rotational resistance that makes the rotation of the guide pins harder and harder.

The conventional hoop material cutter has not sufficiently overcome the adverse influence of the attachment position of the hopper 30 on the action of cutting the hoop material A. For example, when the lower guide 31 is improperly positioned at the cutting time in FIG. 14, the hoop material A1 abuts on the lower end portion of the lower guide 31 and is bent. Consequently, not only a cut chip A3 is deformed, but also the lifetime of the cutting blade becomes shorter due to the poor cutting condition. If the stock guide 32 is positioned improperly, chips or debris 38 may come onto the slide surfaces from the top surface of the movable blade 3, adversely affecting the action of the ram 4.

SUMMARY OF THE INVENTION

Accordingly, it is an object of the present invention to provide cutting blade guides for a hoop material cutter, which ensure the smooth rotation of guide pins for guiding a movable blade and facilitate the maintenance of the guide pins.

It is another object of this invention to provide a hoop material cutter capable of smoothly guiding a hoop material between a fixed blade and a movable blade for adequate cutting of the hoop material and also cutting the hoop material without affecting the action of the movable blade.

To achieve the objects, according to one aspect of this invention, a hoop material cutter for cutting a hoop material comprises a base plate; a ram movable reciprocally while rocking; a movable blade secured to a bottom surface of the ram; a fixed blade secured to a top surface of the base plate; a hopper for guiding a hoop material between the movable blade and the fixed blade; and cylindrical guide pins rotatably fitted in the base plate and each having both ends chamfered, cylindrical surfaces of the guide pins having projections protruding sideways of the base plate for guiding end faces of the movable blade, whereby the hoop material cutter cuts the hoop material while allowing the movable blade to move toward and away from the fixed blade in accordance with an action of the ram.

As both ends of each guide pin are chamfered, the chamfered portions become an oil retainer to ensure sufficient oil supply, and if the cylindrical surfaces of the guide pins wear out, causing settling, the settling is accommodated in the space that is formed by the chamfered portions, thus preventing the guide pins from rotating unsmoothly.

According to another aspect of this invention, a hoop material cutter for cutting a hoop material comprises a base plate; a ram movable reciprocally while rocking; a movable blade secured to a bottom surface of the ram; a fixed blade secured to a top surface of the base plate; a hopper for guiding a hoop material between the movable blade and the fixed blade; and cylindrical guide pins rotatably fitted in the base plate via blocks and each having both ends chamfered, cylindrical surfaces of the guide pins having projections protruding sideways of the blocks for guiding end faces of the movable blade, whereby the hoop material cutter cuts the hoop material while allowing the movable blade to move toward and away from the fixed blade in accordance with an action of the ram.

As both ends of each guide pin are chamfered, the chamfered portions become an oil retainer to ensure sufficient oil supply, and if the cylindrical surfaces of the guide pins wear out, causing settling, the settling is accommodated in the space that is formed by the chamfered portions, thus preventing the guide pins from rotating unsmoothly. Further, as the guide pins are fitted in the base plate via the associated blocks, even when the distances between the end faces of the movable blade and the associated guide pins become longer as in a large hoop material cutter, the extension of the guide pins by the blocks can ensure the guiding action.

According to a modification of the first or second aspect, the amount of the cylindrical surface of each of the guide pins protruding sideways of the base plate or the associated block is smaller than the radius of that guide pin.

As the portion of the cylindrical surface of each guide pin which is greater than its radius is fitted, the guide pin can be held in the fitting hole and can be prevented from coming off the fitting hole in the horizontal direction.

According to another modification, the blocks are provided detachable in a horizontal direction from the base plate facing the end faces of the movable blade.

With this structure, the blocks are located on the base plate side facing the movable blade and are attachable and detachable in the horizontal direction, so that the blocks can be pulled out from the base plate simply by removing the movable blade from the bottom surface of the ram.

According to the third aspect of this invention, a hoop material cutter for cutting a hoop material comprises a base plate; a ram movable reciprocally while rocking; a movable blade secured to a bottom surface of the ram; a fixed blade secured to a top surface of the base plate; and a hopper for guiding a hoop material between the movable blade and the fixed blade, the hopper including a lower guide and a stock guide for stopping feeding of the hoop material, a lower end portion of one of the lower guide and the stock guide abutting on an upper surface of the movable blade in a slidable manner, an end portion of the other one of the lower guide and the stock guide being set approximately at a position of a cutting blade on an upper surface of the fixed blade, whereby the hoop material cutter cuts the hoop material while allowing the movable blade to move toward and away from the fixed blade in accordance with an action of the ram.

With this structure, the lower end portion of one of the lower guide and stock guide of the hopper abuts on the top surface of the movable blade in a slidable manner, eliminating a clearance therebetween, which prevents chips or debris 38 from coming onto the slide surfaces. Further, the end portion of the other one of the lower guide and the stock guide is secured at a position where it does not stick out on the movable blade side from the position of the cutting blade of the fixed blade. This design can prevent a hoop material from being deformed at the time the hoop material is cut, and can elongate the lifetime of the cutting blade.

According to a modification of the third aspect, the width of an opening defined by the lower end portion of the lower guide or the stock guide and a blade edge of the fixed blade is set approximately twice the thickness of a hoop material.

As the width of the opening is set approximately twice the thickness of a hoop material, it is possible to cope with deformation of the hoop material or a change in the thickness of the hoop material.

According to a further modification of the third aspect, a side guide for guiding a hoop material in a widthwise direction thereof is provided on both sides of the opening, and the length of the side guide along the opening is set within the length of the cutting blade.

As the side guide is provided to guide the widthwise movement of a hoop material is guided within the width of the cutting blade, the hoop material can be prevented from having any residual stock removal.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
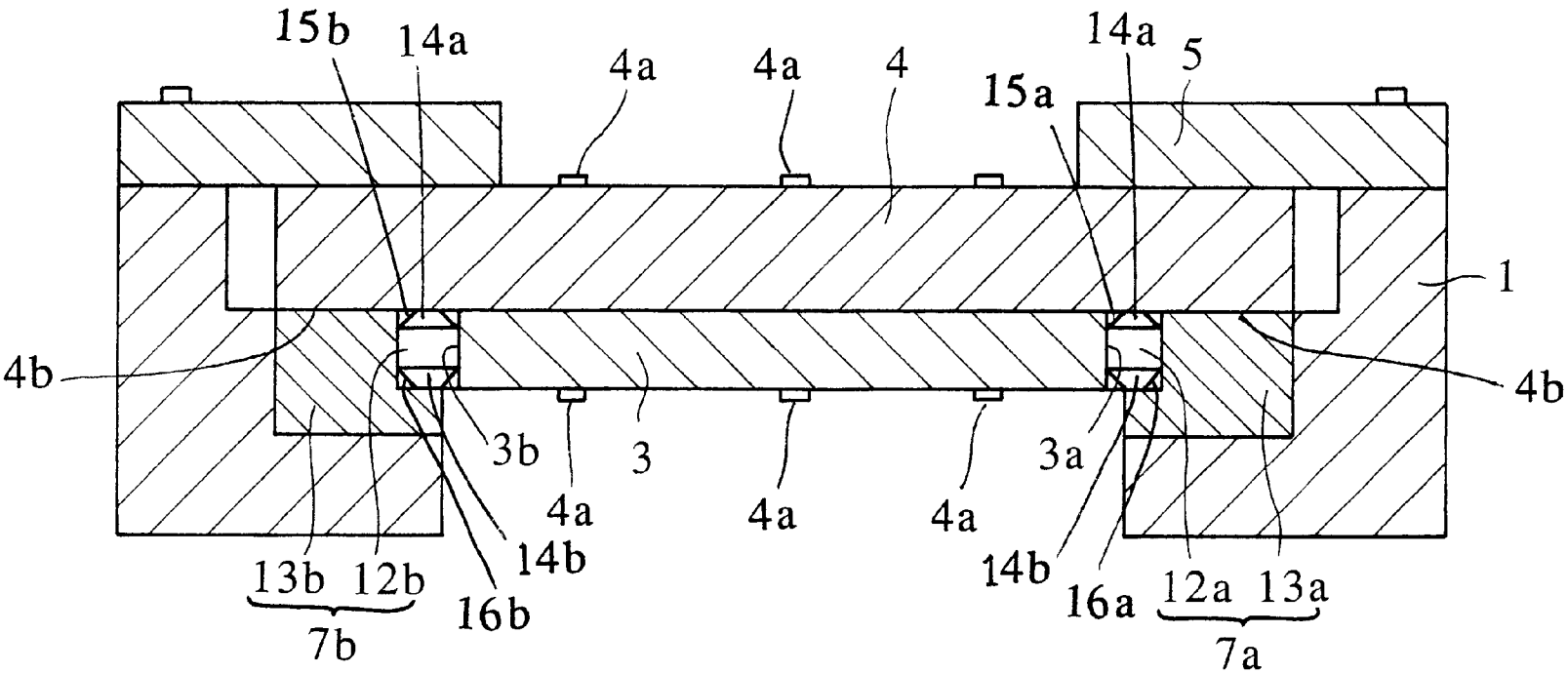
FIG. 1 is a cross-sectional view of a hoop material cutter according to a first embodiment of this invention as seen from the side.

Preferred embodiments of the present invention will now be described referring to the accompanying drawings. Throughout the following description of the individual embodiments, to avoid the redundant description, like or same reference numerals are given to the same or corresponding components.

First Embodiment

Figure 2:
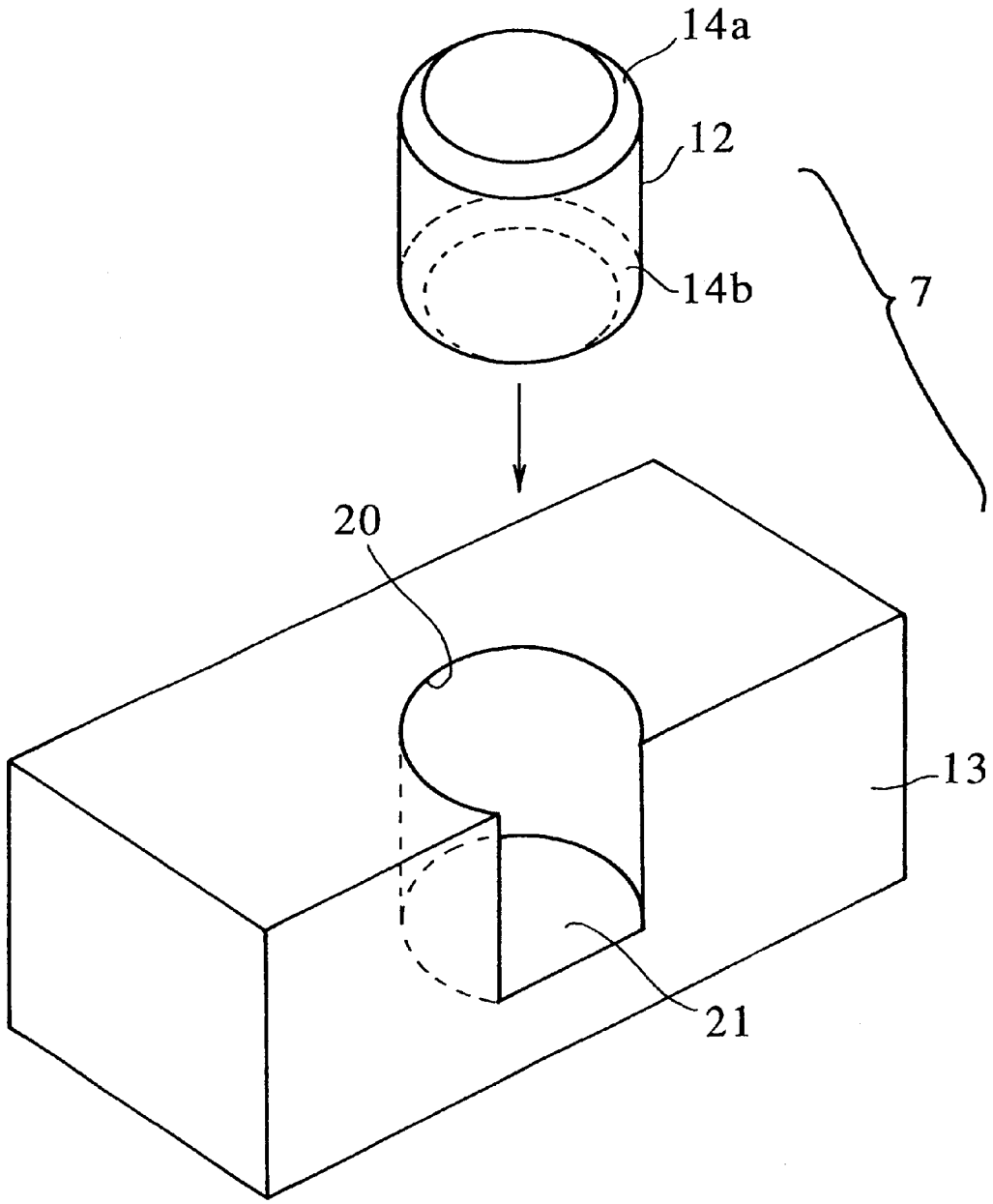
FIG. 2 is a perspective view illustrating how to assemble a guide.
Figure 3:
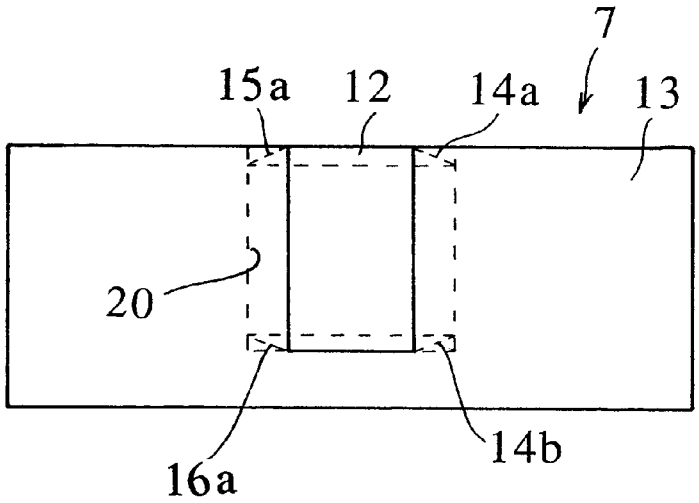
FIG. 3 is a front view of the guide.
Figure 4:
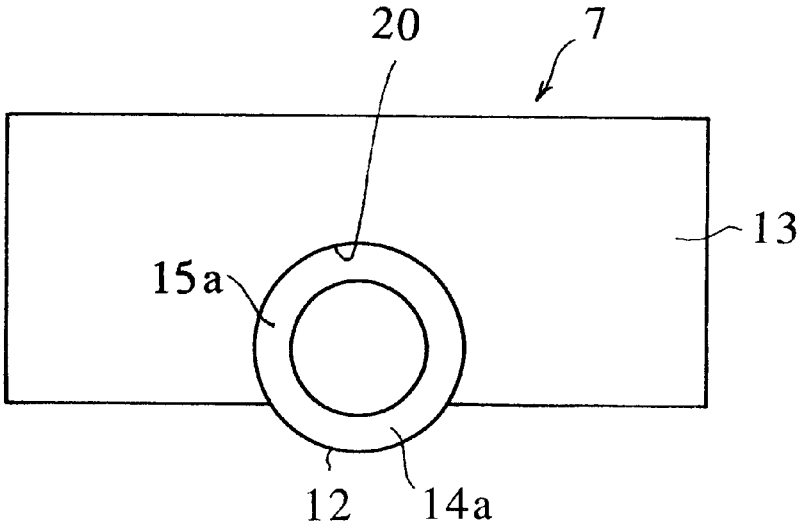
FIG. 4 is a top view of the guide.

FIGS. 1 through 4 illustrate a hoop material cutter according to the first embodiment of this invention. FIG. 1 is a cross-sectional view of the hoop material cutter as seen from the side, FIG. 2 is a perspective view illustrating how to assemble a cutting blade guide, FIG. 3 is a front view of the cutting blade guide, and FIG. 4 is a top view of the cutting blade guide.

Figure 12:
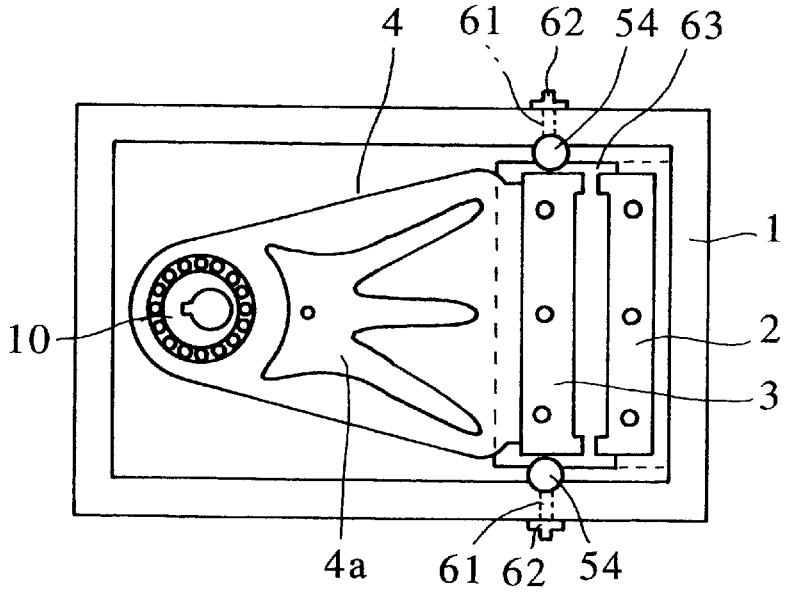
Fig. 12 PRIOR ART
FIG. 12 is a diagram depicting a guide portion of the conventional hoop material cutter.
Figure 13:
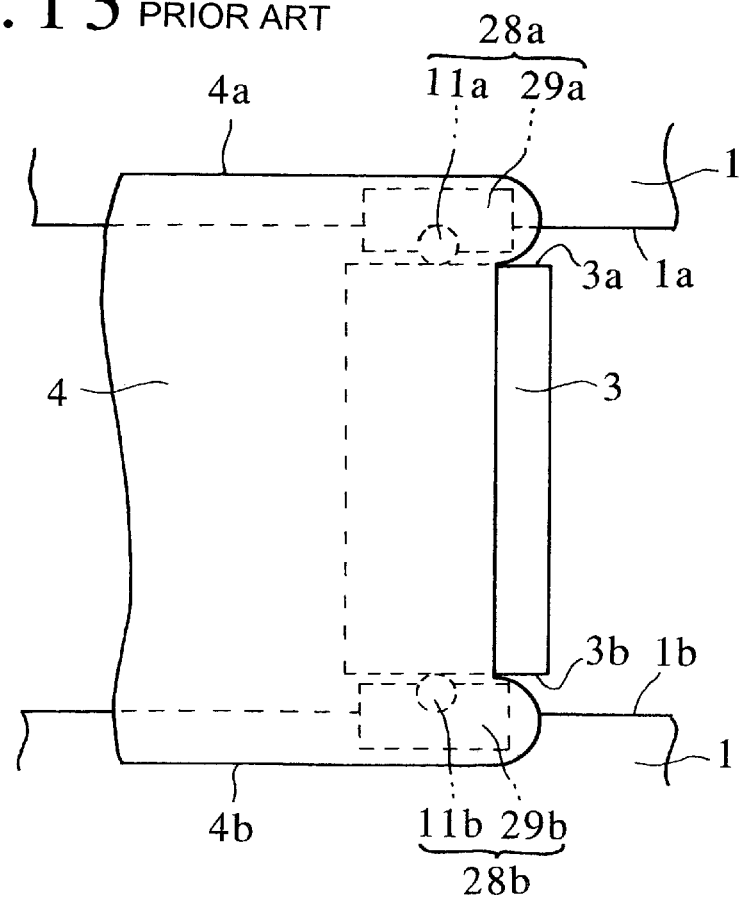
Fig. 13 PRIOR ART
FIG. 13 is a diagram showing another guide portion of the conventional hoop material cutter.
Figure 14:
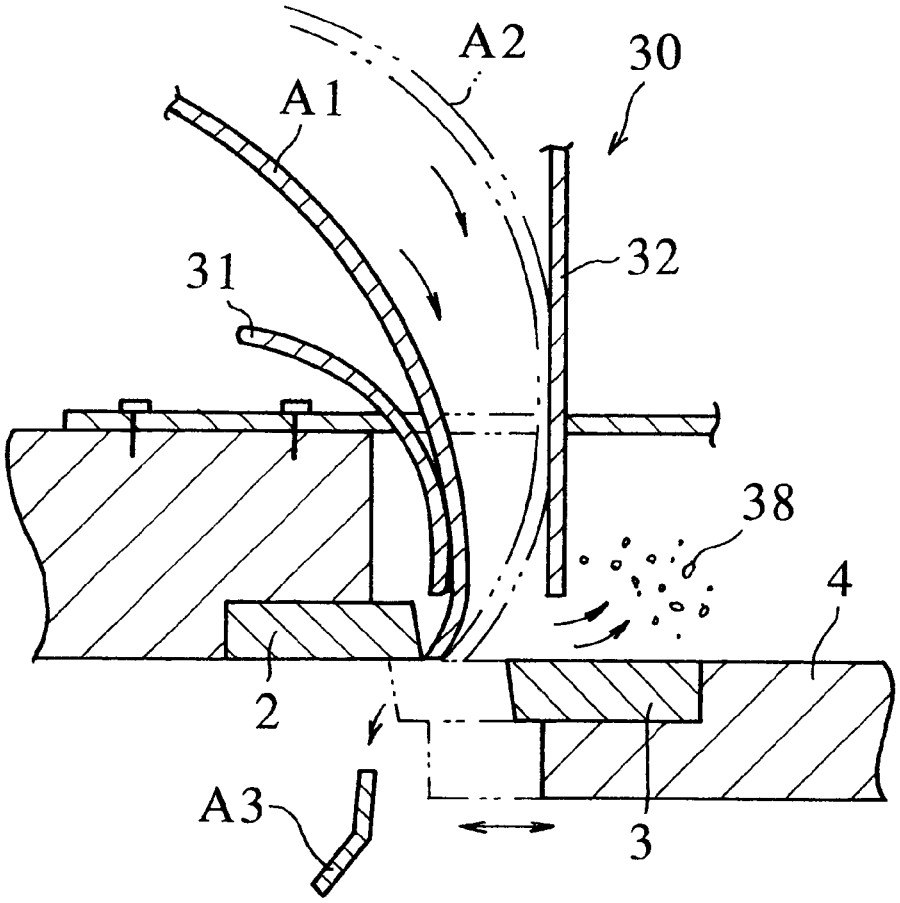
Fig. 14 PRIOR ART
FIG. 14 is an explanatory diagram of a hopper of the conventional hoop material cutter.

A hoop material cutter to which cutting blade guides according to this invention are adapted cuts a hoop material in the following manner. As shown in FIG. 12, a ram 4 moves reciprocally via a bearing 19 while rocking in accordance with the rotation of a cam 10 secured via a key 9 to the shaft 8 of a motor 6, so that a hoop material is cut as a movable blade 3 secured to the front end of the ram 4 at the bottom moves closer to and away from a fixed blade 2 secured to the base plate.

According to this invention, as shown in FIG. 1, this hoop material cutter is designed in such a manner that end faces 3*a* and 3*b* of the reciprocal movable blade 3 are guided by cutting blade guides 7*a* and 7*b*, which respectively comprise a guide pin 12*a* and a block 13*a* and a guide pin 12*b* and a block 13*b*. Each cutting blade guide 7*a* or 7*b* has the cylindrical guide pin 12 fitted in a rotatable fashion in the prismatic block 13 as shown in FIG. 2. The guide pin 12 has a length corresponding to the thickness of the movable blade 3, and has chamfered portions 14*a* and 14*b* on both ends. A hole 20 in which the guide pin 12 is to be fitted is bored in the block 13 at such a position that the cylindrical surface of the guide pin 12 protrudes from one side of the block 13, and has a bottom 21.

The radial amount or size of the guide pin 12 protruding from the side of the block 13 is set smaller than the radius of the guide pin 12 so that the guide pin 12 does not come off the block 13 sideways. That is, the radial amount or the cylindrical surface of the guide pin 12 that is to be fitted in the block 13 is greater than the radius thereof, and the depth of the hole 20 is designed slightly greater than the length of the guide pin 12.

The cutting blade guide 7 is constituted by fitting the guide pin 12 in the block 13 in a direction indicated by the arrow in FIG. 2. As shown in FIGS. 3 and 4, the cylindrical surface of the guide pin 12 of this cutting blade guide 7 sticks out from the side of the block 13 and will not come off the block 13 in the horizontal direction. The lower end of the guide pin 12 abuts on the bottom 21 of the hole 20, while the upper end is retracted slightly from the top surface of the block 13 so that the guide pin 12 can rotate smoothly.

Triangular grooves in cross section, i.e., retainer portions for lubricating fluid 15*a*, 15*b*, 16*a*, 16*b* as shown in FIGS. 1, 3 and 4 are formed between the chamfered portions 14*a*, 14*b* of both longitudinal end faces of the guide pins 12*a*, 12*b* and the inner wall of the holes 20. These retainer portions for lubricating fluid 15*a*, 15*b*, 16*a*, 16*b* not only serve for lubricating fluid retention but also, even if the guide pins 12*a*, 12*b* suffer from deformation or wear of the cylindrical surface thereof and thus from settling, can function to absorb (accommodate) any swell attributed to the settling.

As a pair of the cutting blade guides 7*a* and 7*b* with the above structure are so arranged as to face both end faces 3*a* and 3*b* of the movable blade 3 as shown in FIG. 1, the movable blade 3 can be guided by the guide pins 12*a* and 12*b*. To remove the cutting blade guides 7*a* and 7*b*, a plurality of bolts 4*a* are unfastened and the movable blade 3 is removed from the bottom surface of the ram 4, allowing the cutting blade guides 7*a* and 7*b* to be pulled out horizontally. The guide pins 12*a* and 12*b* remain fitted in the removed cutting blade guides 7*a* and 7*b* and will not come off.

The lubricating fluid to the guide pins 12*a*, 12*b* is supplied to the slide surfaces of the ram 4 via through hole 61 of base plate 1 from nipples in FIG. 12, and is further supplied to the lubricating fluid retainer portions 15*a*, 15*b*, 16*a*, 16*b* of the guide pins 12*a*, 12*b* from the slide surfaces. Accordingly, the lubricating fluid is retained in the lubricating fluid retainer portions 15*a*, 15*b*, 16*a*, 16*b* and will be sufficiently supplied to the rotational portions of the guide pins 12*a*, 12*b*. Further, settling (swell caused by deformation), if it occurs due to wear of the cylindrical surfaces of the guide pins, can be accommodated in the lubricating fluid retainer portions 15*a*, 15*b*, 16*a*, 16*b*, so that no additional rotational resistance will be caused thereby.

According to this embodiment, the guide pins 12*a*, 12*b* are chamfered, and lubricating fluid retainer portions 15*a*, 15*b*, 16*a*, 16*b* are provided between the holes 20 of the blocks 13*a*, 13*b* and the chamfered portions 14*a*, 14*b*. Thus, not only can sufficient lubricating fluid be supplied to the rotational portions but also settling, if it occurs on the cylindrical surfaces of the guide pins 12*a*, 12*b* due to compression and wear to thereby bring about deformation and swell, can be accommodated in the lubricating fluid retainer portions 15*a*, 15*b*, 16*a*, 16*b*, so that unsmooth rotation of the guide pins 12*a*, 12*b* caused by the settling can be avoided. Further, as the guide pins 12*a*, 12*b* are fitted via the associated blocks 13*a*, 13*b*, the movable blade guides 7 can be pulled out horizontally from the base plate 1 simply by detaching the movable blade 3 at the time of maintenance for the movable blade guides 7.

Second Embodiment

Figure 5:
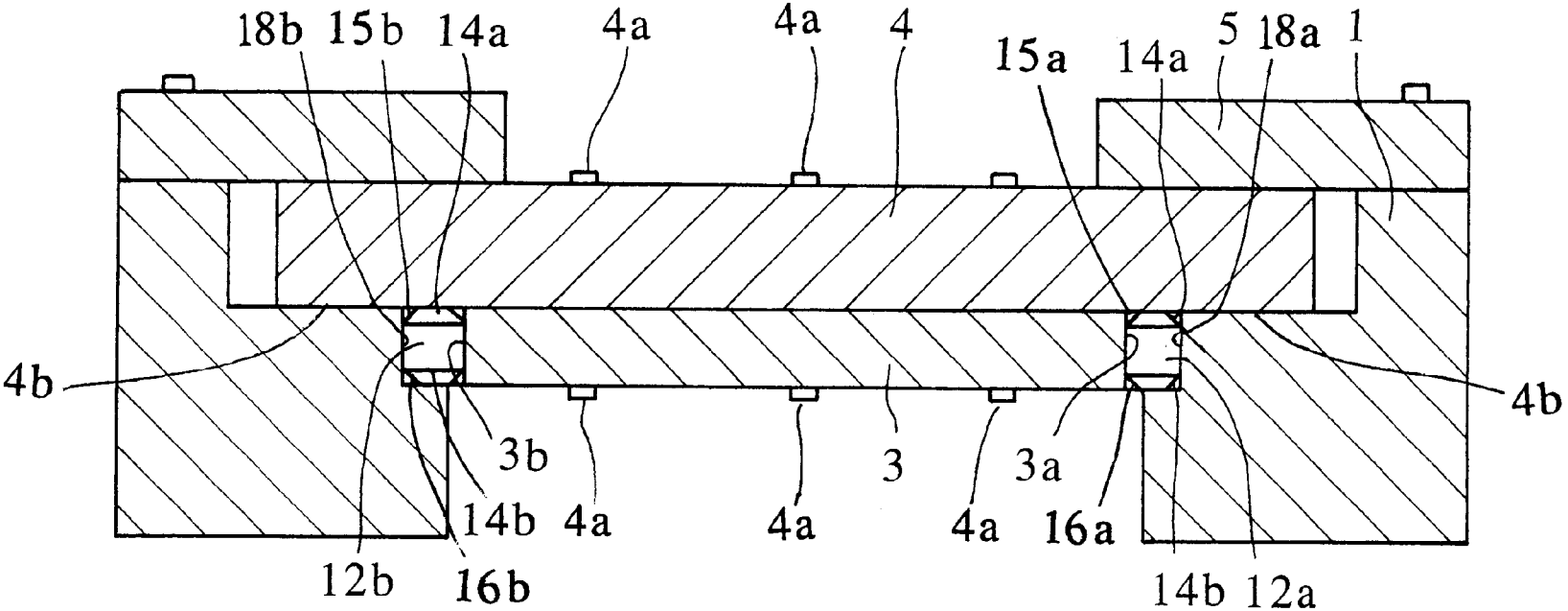
FIG. 5 is a cross-sectional view of a hoop material cutter according to a second embodiment of this invention as seen from the side.

FIG. 5 is a cross-sectional view of a hoop material cutter according to the second embodiment of this invention as seen from the side.

In this embodiment, the guide pins 12 are provided directly on the base plate 1 without using the blocks 13 in the first embodiment, and the other structure is the same as that of the first embodiment. As shown in FIG. 5, the guide pins 12*a*, 12*b* are rotatably fitted in the holes 18*a*, 18*b* of the base plate 1, respectively. The lengths of the guide pins 12*a*, 12*b* and the depths of the holes 18*a*, 18*b* are the same in the first embodiment. Lubricating fluid retainer portions 15*a*, 15*b*, 16*a*, 16*b* are provided between the guide pins 12*a*, 12*b* and the inner walls of the holes 18*a*, 18*b*.

In the case, the hoop material cutter can be manufactured inexpensively at the price of the inconvenience that because the cylindrical surface of each guide pin 12*a* or 12*b* greater in radial amount that the radius of the guide pin is directly fitted in the base plate, the ram 4 should be removed in order to pull out the guide pin 12. Further, as in the first embodiment, the lubricating fluid is sufficiently supplied to lubricating fluid retainer portions 15*a*, 15*b*, 16*a*, 16*b* are provided between the guide pins 12*a*, 12*b* and the inner walls of the holes 18*a*, 18*b*, so that the guide pin 12*a* or 12*b* rotates smoothly, settling, if it occurs on the cylindrical surface of the guide pin due to wear-out of the cylindrical surface, can be accommodated in the above-mentioned lubricating fluid retainer portions 15*a*, 15*b*, 16*a*, 16*b*, thus preventing an additional rotational resistance from being imparted.

According to this embodiment, the guide pins 12*a*, 12*b* are chamfered, so that the same lubricating fluid retainer portions 15*a*, 15*b*, 16*a*, 16*b* as in the first embodiment are provided. Thus, not only can sufficient lubricating fluid be supplied to the rotational portions but also settling, if it occurs on the cylindrical surfaces of the guide pins 12*a*, 12*b* due to wear to thereby bring about deformation and swell, can be accommodated in the lubricating fluid retainer portions 15*a*, 15*b*, 16*a*, 16*b*, so that unsmooth rotation of the guide pins 2*a*, 12*b* caused by the settling can be avoided.

Third Embodiment

The third embodiment of this invention will now be described with reference to the accompanying drawings.

Figure 8:
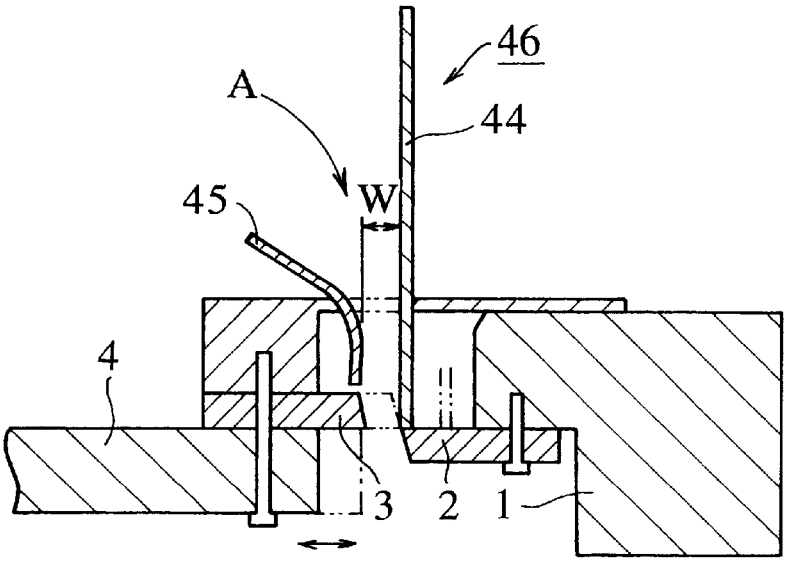
FIG. 8 is a cross-sectional view of the essential portions of the hopper of the hoop material cutter according to the third embodiment and the peripheral portions thereof.
Figure 9:
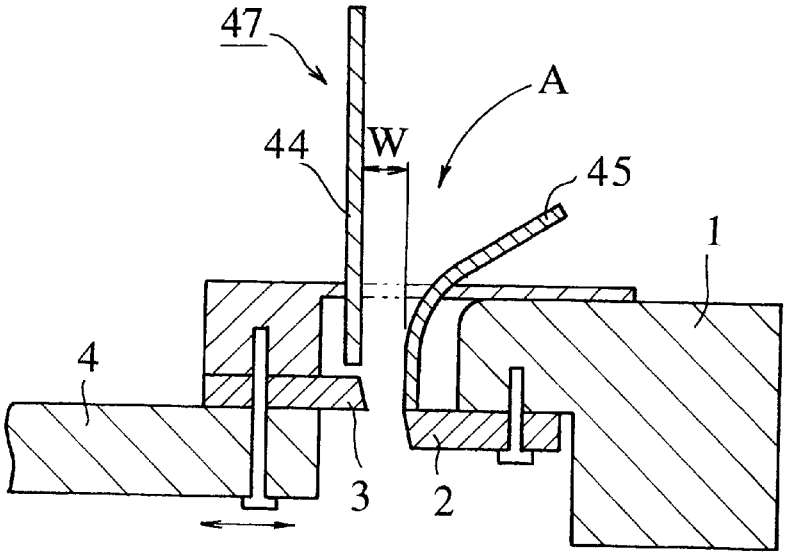
FIG. 9 is a cross-sectional view of the essential portions of the hopper of the hoop material cutter according to the third embodiment and the peripheral portions thereof.
Figure 10:
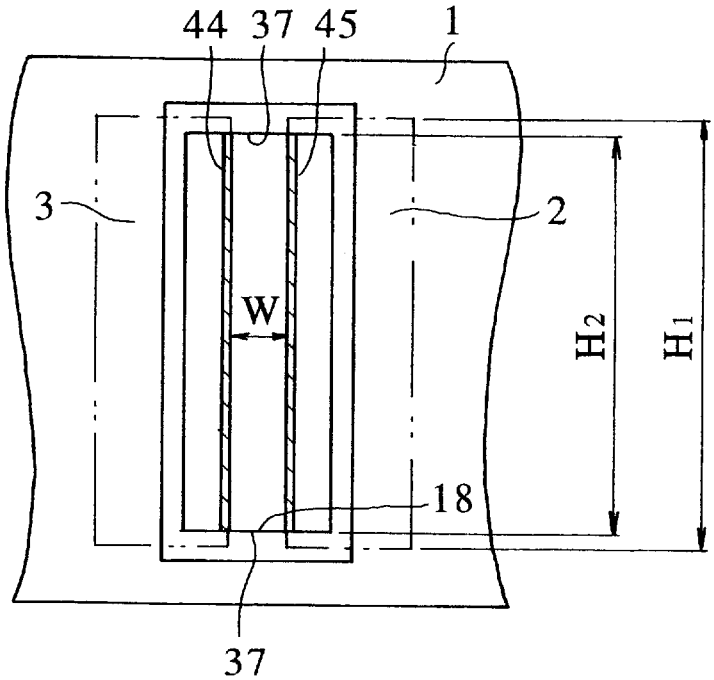
FIG. 10 is a top view showing a side guide provided at the opening portion of the hopper.

FIGS. 6 through 10 illustrate a hoop material cutter according to the third embodiment. FIGS. 6 to 9 are cross-sectional views of the essential portion showing various examples of the relationship of the attachment position of a hopper with respect to the cutting blade, and FIG. 10 is a top view showing a side guide.

Figure 11:
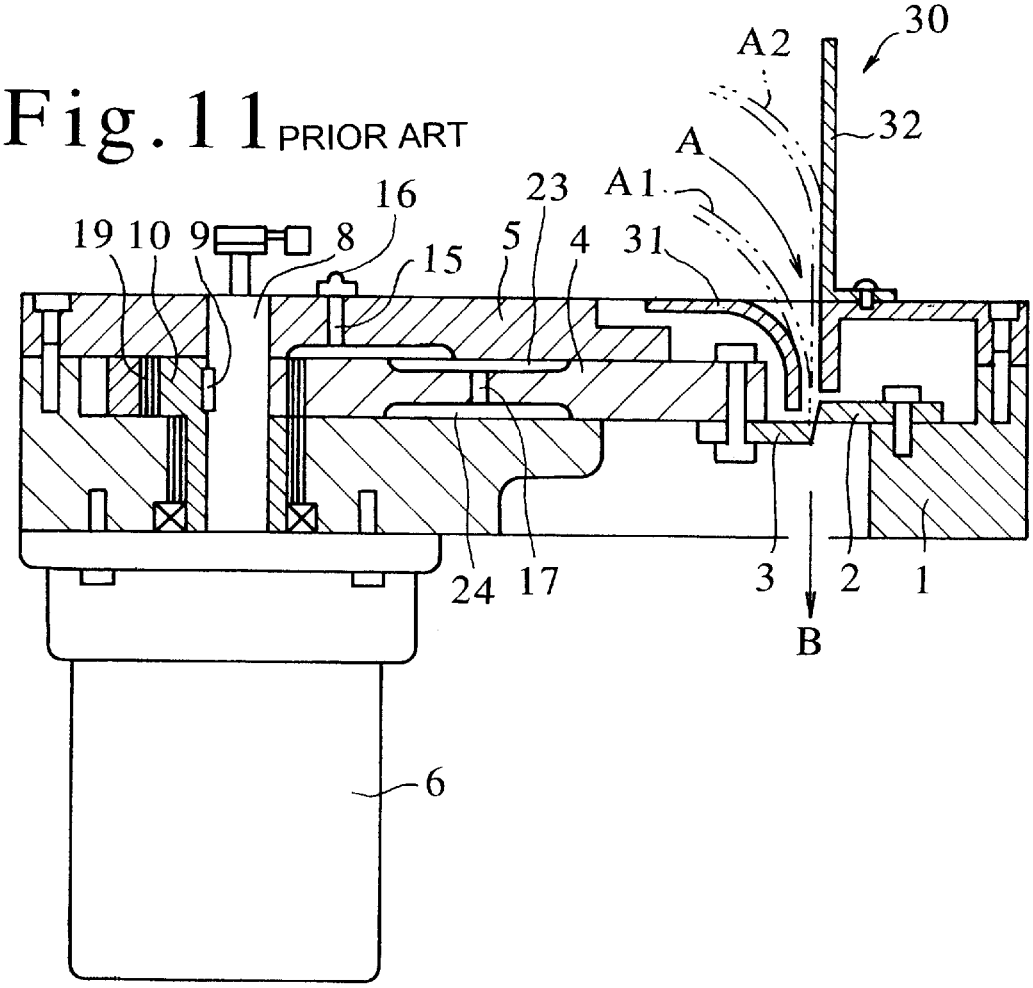
Fig. 11 PRIOR ART
FIG. 11 is a cross-sectional view of a conventional hoop material cutter.

A hoop material cutter to which this embodiment is adapted cuts a hoop material in the following manner. As shown in FIG. 11, for example, the ram 4 reciprocates via the bearing 19 while rocking in accordance with the rotation of the cam 10 secured via the key 9 to the shaft 8 of the motor 6, so that the movable blade 3 secured to the front end of the ram 4 at the bottom moves closer to and away from the fixed blade 2 secured to the base plate 1, thereby cutting a hoop material A that is supplied to the cutting blade portion.

A hopper 40 to be attached to this hoop material cutter comprises a lower guide 41 having an arcuate guide surface for guiding a hoop material A in the feeding direction indicted by "A1" and a stock guide 42 formed upright to stop feeding of the hoop material A as indicated by "A2", both guides being formed of a steel plate.

There are various types of hoop material cutters with the above-described structure; for example, the movable blade 3 or the fixed blade 2 may be attached to the bottom surface or top surface of the ram 4 or the base plate 1, and the direction of the hopper 40 may vary as shown in FIGS. 6 to 9. Thus, the positions of the attachment of the hopper to those hoop material cutter will now be discussed.

Figure 6:
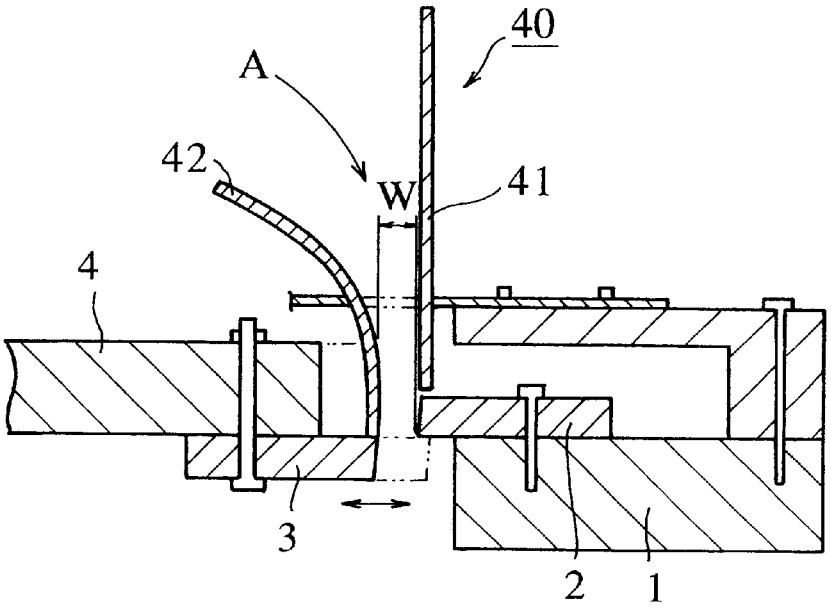
FIG. 6 is a cross-sectional view of the essential portions of a hopper of a hoop material cutter according to a third embodiment of this invention and peripheral portions thereof.

In a case of the hoop material cutter shown in FIG. 6, the movable blade 3 is fixed as a lower blade to the bottom surface of the ram 4 which makes a reciprocal action in the direction of the arrow, and the fixed blade 2 is secured as an upper blade to the top surface of the base plate 1. The hopper 40 to be installed in this hoop material cutter can feed the hoop material A from upper left. The lower guide 23 in this case is shaped in an arcuate form to guide the bottom side of the hoop material A that is fed from the left, and has its lower end abutting on the surface of the movable blade 3 in a slidable manner. The stock guide 41 is formed upright to stop feeding of the hoop material A, and its inner wall (the side surface on the hoop material side) at the lower end is set at the position of the blade edge of the fixed blade 2 or at a position slightly retracted from the blade edge.

The width W of an opening which is formed between the inner wall (the side surface on the hoop material side) of the lower guide 42 at its lower end and the blade edge of the fixed blade 2 is set approximately twice the thickness of the hoop material in order to cope with a probable variation, deformation or the like of the thickness of the hoop material.

Figure 7:
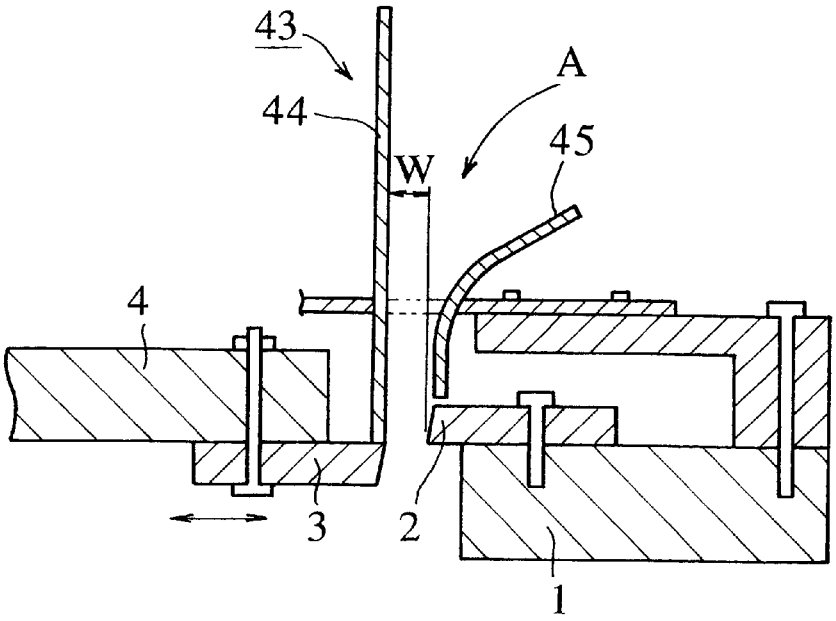
FIG. 7 is a cross-sectional view of the essential portions of the hopper of the hoop material cutter according to the third embodiment and the peripheral portions thereof.

The direction of the hopper 43 of the hoop material cutter depicted in FIG. 7 is set opposite to that of the hopper in FIG. 6. In this case, the lower end of a stock guide 44 abuts in a slidable manner on the top surface of the movable blade 3, and the lower end of a lower guide 45 is attached at a position slightly retracted from the blade edge of the fixed blade 2 so that the lower end does not protrude from the blade edge of the fixed blade 2.

In the hoop material cutters in FIGS. 8 and 9, the movable blade 3 is secured to the top surface of the ram 4 and the fixed blade 2 to the bottom surface of the base plate 1, as opposed to those of the hoop material cutters in FIGS. 6 and 7, and hoppers 46 and 47 are likewise installed in the opposite directions. The hopper 47 is secured to the ram 4 so that it reciprocates together with the ram 4.

In this case, the fixed blade 2 becomes a lower blade, so that the lower end of the stock guide 44 or the lower guide 45 abuts in a slidable manner on the top surface of the fixed blade 2, while the inner surface of the lower end of the lower guide 45 or the stock guide 44 is secured to the top surface of the movable blade 3 serving as an upper blade, at a position where the inner surface does not stick out from the cutting blade. The setting of the width W of the opening is the same as the aforementioned one.

In FIG. 10, a side guide 37 formed integral with the base plate 1 is provided in the lengthwise direction (sideways) of the opening W that is formed by the lower guide 45 and the stock guide 44, and the width H2 of this side guide 37 is set narrower than the blade width H1 of the fixed blade 2 and the movable blade 3. This design restricts the lateral movement of a hoop material over the blade width, and prevents the occurrence of the residual stock removal of the hoop material.

In cutting the hoop material A with the thus constituted hoop material cutter, the hoop material A is supplied to the cutting blade portions of the movable blade 3 and the fixed blade 2 from the direction of the arrow and the ram 4 is activated to move the movable blade 3 back and forth while rocking, thereby cutting the hoop material A stroke by stroke of the ram 4.

In this case, the hoop material A abuts on the stock guide 44 and stops being fed during cutting, and is then fed to the cutting blade portions to be cut when the opening is formed next, and those actions are repeated.

As the lower end of the lower guide 45 or the stock guide 44 located on the top surface of the upper blade is approximately at the position of the cutting blade in this embodiment at the time of feeding the hoop material A to the cutting blade portions, the hoop material A can slide into the cutting blade portions. Unlike the prior art, this design prevents the hoop material A from being pressed and bent by the lower end of the hopper, so that cut chips are not deformed.

Further, the lower end of the lower guide 45 or the stock guide 44 abuts in a slidable manner on the top surface of the lower blade, there is no clearance therebetween, thus preventing chips or debris, produced at the time of cutting the hoop material A, from entering the bottom side of the hopper.

Although the hopper of this embodiment is formed of a steel plate, the hopper may be formed into various shapes using cast iron or other materials.

According to the hoop material cutters recited in claims 1 to 5, as described above, because both ends of each guide pin are chamfered, the chamfered portions become an oil retainer to ensure sufficient oil supply, and if the cylindrical surfaces of the guide pins wear out, causing settling, the settling is accommodated in the space that is formed by the chamfered portions, thus preventing the guide pins from rotating unsmoothly.

As the portion of the cylindrical surface of each guide pin which is greater than its radius:is fitted, the guide pin can be prevented from coming off the fitting hole in the horizontal direction. When the guide pins are attached to the base plate via blocks, the guide pins can be attached and detached together with the blocks in the horizontal direction, and the guide pins can be pulled out merely by removing the movable blade. This ensures easier maintenance.

Further, as the guide pins are fitted in the base plate via the associated blocks, even when the distances between the end faces of the movable blade and the associated guide pins become longer as in a large hoop material cutter, the extension of the guide pins by the blocks can ensure the guiding action.

According to the hoop material cutter recited in claim 6, it is difficult for chips or debris, produced at the time of cutting a hoop material, to enter on the bottom side of the lower guide from the top surface of the. lower blade, so that such chips or debris does not adversely affect the action of the ram. Further, since deformation of a hoop material such as bending does not occur at the time it is cut, it becomes easier to process chips after cutting and no excessive stress will act on the cutting blade, thus ensuring a longer lifetime of the cutting blade.

As the width of the opening is set approximately twice the thickness of a hoop material as recited in claim 7, it is possible to cope with deformation of the hoop material or a change in the thickness of the hoop material. If this set value becomes smaller than about twice the thickness of a hoop material, it is difficult for the hoop material to pass through the opening, whereas if the set value becomes greater than the latter value, a hoop material may "play" inside the opening and may not be cut smoothly.

As a hoop material is guided within the width of the cutting blade, the hoop material does not have a residual stock removal as indicated by the structure. Accordingly, cut chips will not be chained, ensuring easier processing of the chips.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A hoop material cutter for cutting a hoop material, comprising:

a base plate;

a ram movable reciprocally while rocking on the base plate;

a movable blade secured to a bottom surface of said ram;

a fixed blade secured to said base plate so as to be opposite to said movable blade, and a hopper provided on said base plate for guiding a hoop material between said movable blade and said fixed blade, wherein said hoop material cutter cuts said hoop material having been guided by said hopper while allowing said movable blade to move while rocking toward and away from said fixed blade in accordance with an action of said ram, and wherein said base plate has holes, and said movable blade is furnished with guide pins for guiding lateral sides of said movable blade, both longitudinal end faces of said guide pins being chamfered, said guide pins fitted in said holes of said base plate so as to provide clearances defined by said holes of said base plate and both longitudinal ends of said guide pins, said clearances constituting retainer portions for lubricating fluid supplied for said guide pins of said movable blade.

2. The hoop material cutter according to claim 1, wherein said base plate is furnished with holes for accommodating guide blocks, said guide blocks are detachably fitted in said holes, and said guide pins are detachably fitted in said guide blocks, so that, at the time of a replacement (change) or repair of said guide pins, this can be accomplished by detaching only said guide blocks from said base plate holes.

3. The hoop material cutter according to claim 1, wherein the amount of cylindrical surface of each of said guide pins protruding sideways of said base plate is smaller than a radius of that guide pin.

4. The hoop material cutter according to claim 2, wherein the amount of cylindrical surface of each of said guide pins protruding sideways of said base plate is smaller than a radius of that guide pin.

5. The hoop material cutter according to claim 2, wherein said blocks are provided detachable in a horizontal direction from said base plate facing said end faces of said movable blade.

* * * * *